United States Patent [19]

Schupphaus

[11] Patent Number: 4,889,393

[45] Date of Patent: Dec. 26, 1989

[54] DRUM CUTTER-LOADER FOR UNDERGROUND MINING MACHINE

[75] Inventor: Herbert Schupphaus, Bochum, Fed. Rep. of Germany

[73] Assignee: Gebr. Eickhoff Maschinenfabrik u. EisengieBerei mbH, Bochum, Fed. Rep. of Germany

[21] Appl. No.: 261,102

[22] Filed: Oct. 24, 1988

[30] Foreign Application Priority Data

Nov. 14, 1987 [DE] Fed. Rep. of Germany ..... 3738801

[51] Int. Cl.[4] ..... F21C 25/08; F21C 27/00

[52] U.S. Cl. ..... 299/42; 299/53

[58] Field of Search ..... 299/18, 29, 42–46, 299/53, 54, 76

[56] References Cited

FOREIGN PATENT DOCUMENTS 1514914 3/1942 Fed. Rep. of Germany .

2612671 9/1980 Fed. Rep. of Germany .

620594 8/1978 U.S.S.R. ..... 299/53

1132741 11/1968 United Kingdom .

2084220 4/1982 United Kingdom ..... 299/76

*Primary Examiner*—Stephen J. Novosad

*Assistant Examiner*—David J. Bagnell

*Attorney, Agent, or Firm*—Clifford A. Poff

[57] ABSTRACT

In a drum cutter-loader underground mining machine, wherein the drum is rotatably carried by an arm arranged adjacent to the coal face side of the machine. The arm is pivotally adjusted by a number of pressure cylinders and carried on an axis arranged between a machine body and a housing of a drive motor for the drum. The cylinders are carried by the machine body on a common axis with their piston rods connected to the housing on a common axis, the pivot axes of the arm, cylinders and the piston rod connections being parallelly arranged.

8 Claims, 3 Drawing Sheets

DRUM CUTTER-LOADER FOR UNDERGROUND MINING MACHINE

BACKGROUND OF THE INVENTION

The invention relates to a drum cutter-loader machine for underground mining whose two cutting drums are each mounted on individual support arms which are separately connected by gearing to individual driving motors arranged on the side of the support arms opposite their drums. As to each of the support arms, the motor is arranged in a protective housing which in turn is fastened to the support arm. Pressure cylinders are provided so as to be able to swivel the arm about an axis mounted on the machine body which is parallel to the mine floor and in the direction of the coal face side.

Equipping drum cutter-loader machines with a swivelling arm axis which is fixed in front and on the top of the machine body and fixed parallel to the mine floor at right angles to the direction of travel of the machine forms part of the existing prior art, as German Patent No. 26 12 671 illustrates. In one form of the prior machines a support arm to which the cutting drum is connected also carries a driving motor on the side opposite the drum side which is situated parallel to the swivelling axis of the support arm. The driving motor is situated inside a protective housing which is fastened to the side wall of the support arm. The housing at its end extending in the direction away from the support arm is supported by a shoulder that forms a swivelling axis on the machine body. A swivel cylinder, which initiates the pivotal movement of the support arm, acts through a rocking lever. In order to reduce the overall height of the machine, the machine body is provided at each of its two ends with a cavity which serves to accept the swivel cylinder, and which is situated inside the plane of movement of the rocking lever and emerges from the floor area of the machine body.

Moreover, it is also known in the case of drum cutter-loader machines which are suitable for long-front mining, to equip the support arm of the cutting drum with two swivel cylinders, as British Patents No. 11 32 741 illustrates. Both swivel cylinders are mounted in an articulated manner on the support arm, which is swivelled about an axis which is pointed towards the coal face side. In this design, since the two swivel cylinders are situated above the machine body and the support arm, they increase the overall height of the coal-cutting machine.

In both of the above cases the arm which carries the drum i.e. breaking-down tool is fixed to the machine body in the immediate vicinity of the coal face. Consequently, the adjusting cylinders are also situated in this area of the machine body. As a result, it is not possible to drive the machines described in the first-mentioned publication with a cog rack or pin-toothed rack of the long wall conveyor means which is arranged on the coal face side, because the swivel cylinders due to their mounting arrangement, particularly in the case of low-constructed cutter-loaders, would collide in their elevating motion with the cog rack or pin-toothed rack. On the contrary, machines described in the last-named publication can be used only in seams of great thickness.

A coal-cutting machine which is provided with a swivel frame carrying a rotating cutter bar is also known through German Registered Design Patent No. 15 14 914. This swivel frame is mounted on a slide frame so as to be swivellable about a horizontal axis which is pointed towards the coal face side, and is pivoted by pressure cylinders into a working position which in turn allows the cutter bar to adopt its working position. Two or more of these pressure cylinders are combined into one block and are arranged one behind the other with a small overall width in the longitudinal direction of the coal-cutting machine in which their pistons can be actuated simultaneously.

SUMMARY OF THE INVENTION

While as noted above the machines are usually provided with drum cutters at the opposite ends of the machines, hereinafter the invention will only be referred to in terms of one of the drum cutters and its associated components.

The object and purpose of the present invention is to construct a drum cutter-loader machine for use in underground mining in such a way that on the one hand, it can be used in deep seams, and on the other hand, it can be driven to and fro over the length of the long wall face with a cog-rack or pin-toothed rack of the long wall conveyor means which is arranged on the coal face side or on the opposite side known as the goaf side.

In order to solve this problem, the invention improves on the cutter-loader hereinbefore described by providing that the pressure cylinders be arranged between the machine body and the motor housing, where on the one hand, they act with their piston rods on the protective housing of the driving motor, being able to swivel about a common axis which is parallel to the swivelling axis of the support arm, and on the other hand, are mounted on the machine body so as to be able to swivel about a common axis which is parallel to the above mentioned axis.

As several pressure cylinders can be accommodated in this way between the protective housing and the machine body, the force which is necessary for moving the support arm can be applied with cylinders of smaller diameter, and because of the close proximity between the support arm swivelling axis and the pressure cylinder, the swivelling path which is necessary for adjusting the cutting drum can be obtained even if the pressure cylinders have a shorter overall length.

In this arrangement, the space on the coal face side of the machine body remains clear for the employment of a cog rack or pin-toothed rack. For this reason, drum cutter-loaders of this type of construction can be driven with a rack arranged both on the goaf side and also on the coal face side, without a considerable increase in the overall height of the machine due to the cylinder arrangement employed.

It is advantageous in some machines if two rows of pressure cylinders situated one above the other are provided, which enclose between them the swivelling axis of the support arm. Although, a certain reduction of the pressure cylinder diameters will be necessary in some cases in this arrangement, the smaller adjusting force necessitated by this can be more than compensated for by the larger number of pressure cylinders which are then available. In this case, it is recommended that the pressure cylinders be constructed so that they can be bilaterally actuated and actuated by rows in the same direction in such a way that both rows of cylinders act simultaneously in the same swivelling direction on the support arm.

In order to reduce the construction space between the protective housing and the machine body which is necessary for the pressure cylinders, or to be able to increase the length of the stroke with the same construction space, the ends of two rows of pressure cylinders adjacent to the machine body can be provided with diametrically opposite trunions, which form the swivelling axis of the pressure cylinders with the trunions being carried, for example, in ribs of the machine body situated between the individual pressure cylinders, which enclose other ribs of the protective housing some of which can also accept the swivelling axis of the support arm.

Advantageously, in certain cases the protective housing can have a cover which extends into the area of the support arm swivelling axis and also laterally encloses the row of pressure cylinders which protects the pressure cylinders from dirt, but particularly from damage caused by falling debris.

In a protective housing constructed in this way, it is recommended that the lateral walls of the cover in the area above the axis of the driving motor be connected by means of the support arm swivelling axis to front-ended shoulders of the machine body in an articulated manner, and that space merely be provided underneath the swivelling axis for the arrangement of the pressure cylinders, which can be mounted in cavities of the machine body on the one hand, and in cavities of the protective housing on the other. By this means, the pressure cylinders, even in the case of low-built machines, can be arranged at a spacing from the support arm swivelling axis which is adequate for producing the adjusting movement which is necessary for swivelling the support arm.

SUMMARY OF THE DRAWINGS

Two exemplified embodiments of the invention are illustrated in the accompanying drawings, in which:

With reference to FIGS. 1 and 2, the drum cutter-loader machine has a machine body 1. The machine can be driven above the long wall conveyor means 2 for which purpose it is engaged by a driving wheel 3 of a winch 4 and rack 5 which is fastened, in the exemplified embodiment, on the goaf side of the long wall conveyor means 2. A support arm 6, being as noted above, one of two such arms arranged on opposite ends of the machine body, is swivellablely mounted about a horizontal axis 7 pointed towards the coal face side and carries a cutting drum 8 which serves as a breaking-down tool. The latter is connected by gearing via a gear chain, not shown, which is inside the support arm 6, to a driving motor 9 shown best in FIG. 2, which is situated on the side of the support arm opposite the cutting drum 8. The motor 9 is situated inside a protective housing 10, which is screwed to the support arm 6. On its half-circumference facing the machine body 1, the protective housing 10, in the exemplified embodiment as per FIGS. 1 and 2, carries ribs 11 distributed over its length which are arranged at a spacing from each other and each accept between them a shoulder 12 which projects from the front end of the machine body. The swivelling axis 7 of the support arm 6 runs through trunions bores arranged co-axially to each other, in the ribs 11 and shoulders 12, and swivellablely connects together the machine body on the one hand, and the protective housing 10 and support arm on the other.

Figure 1:
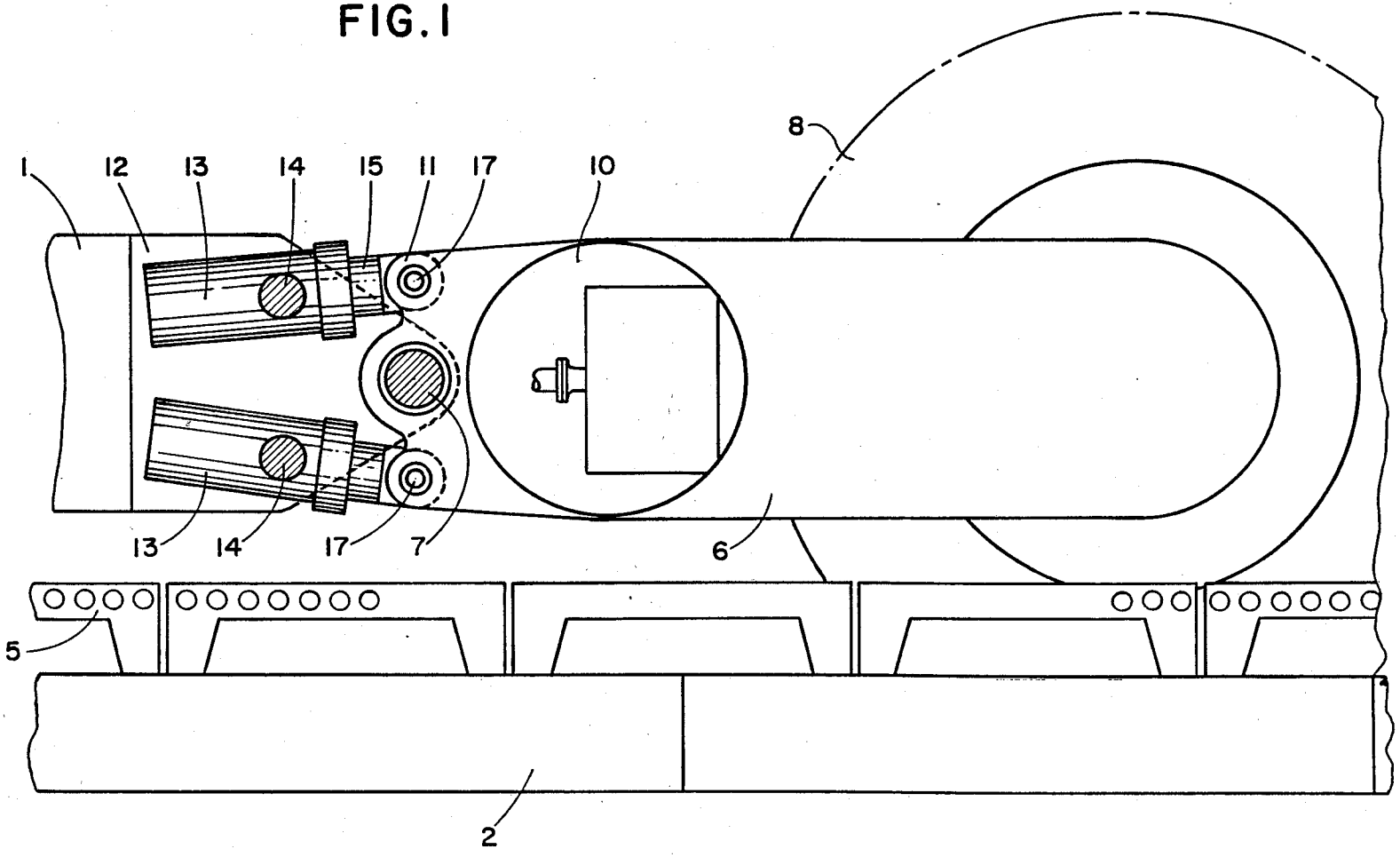
FIG. 1 shows a partial elevational view, partly in section, of a drum cutter-loader machine incorporating the features of the present invention.
Figure 2:
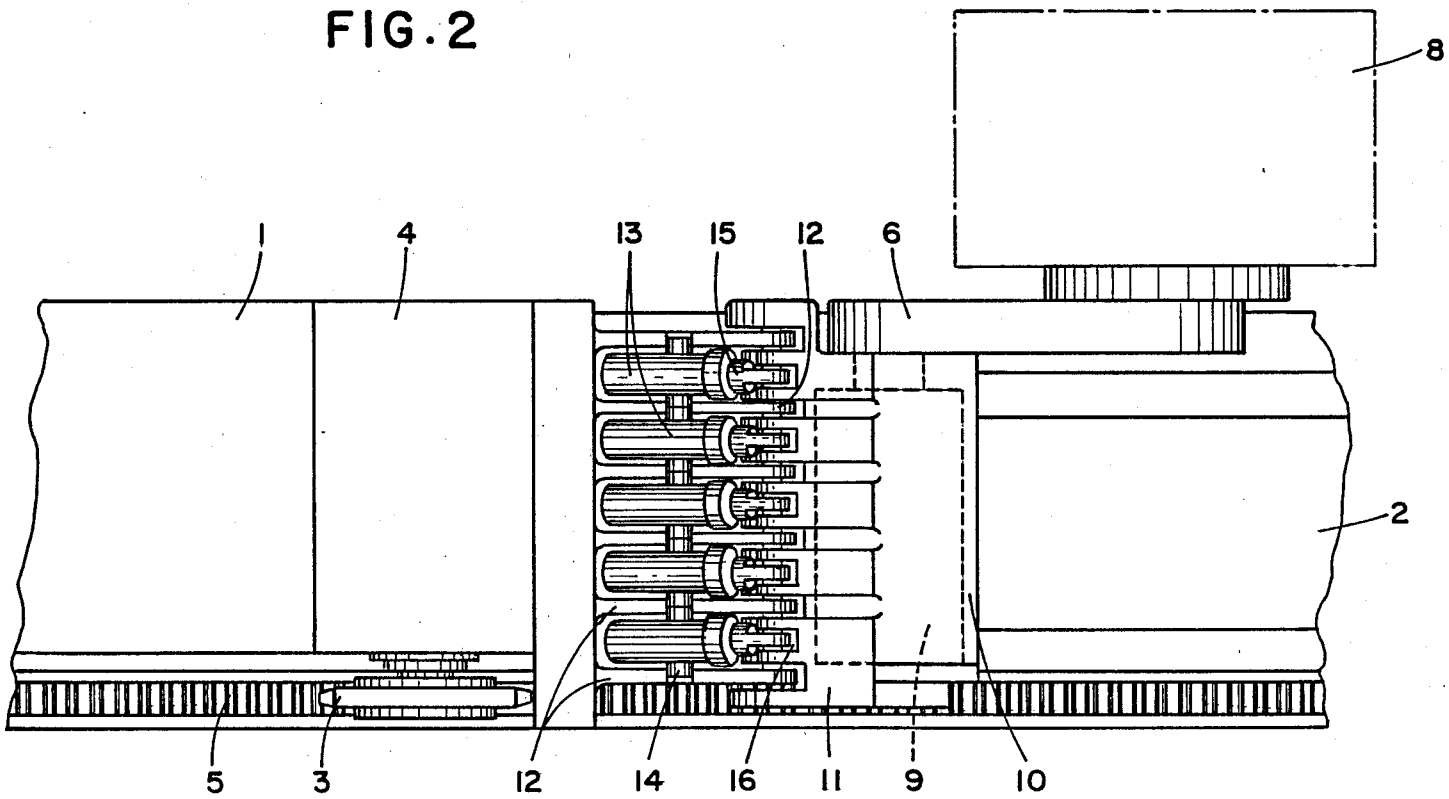
FIG. 2 shows a plan view of FIG. 1.

Pressure cylinders 13, which can be actuated bilaterally, creates the adjusting movement of the support arm 6. They are situated between the protective housing 10 and the machine body in two rows lying one above the other, and are so arranged, that a pressure cylinder 13 is situated in each case between two front-ended shoulders 12 of the machine body, which is best shown in FIG. 2. Their diametrically opposite lateral trunions 14, with which they engage in bores of the shoulders 12 co-axial to each other, give them the necessary mobility to initiate the swivelling motion of the support arm. With their piston rods 15 they act on the ribs 11 of the protective housing 10, which, as shown in FIG. 1, are distributed on both sides of the swivelling axis 7 of the support arm, and therefore at the top and bottom, and extend roughly over the half of the circumference of the protective housing 10 which faces the machine body 1. Each of the piston rods 15 engages in a cavity 16 of one rib 11 and is connected to the protective housing 10 on an axis 17 which is parallel to the support arm swivelling axis 7. Since the pressure cylinders 13 are actuated in rows in the same direction in such a way that both rows of cylinders act simultaneously in the same swivelling direction on the support arm 6, the necessary adjusting forces can also be created with pressure cylinders 13 of a relatively small diameter.

Figure 3:
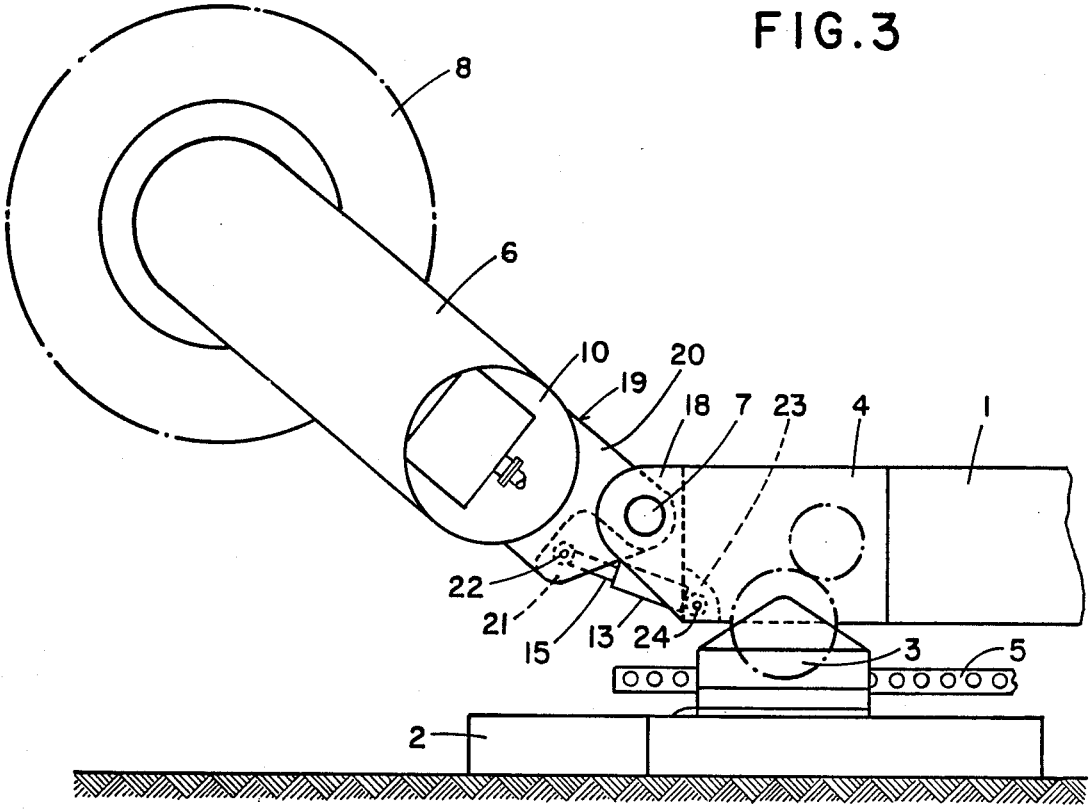
FIG. 3 shows in the form of a partial elevational view another embodiment of the invention.

In the second embodiment illustrated in FIG. 3, similar reference numbers of FIGS. 1 and 2 will designate similar components, the machine body 1 of the drum cutter-loader machine is equipped with two front-ended shoulders 18, which are situated more or less flush with the side walls of the machine body. In the space which is between these two shoulders 18 a protective housing 10 of the driving motor 9 engages with its cover 19, whose lateral walls 20 extend over the top of the protective housing 10. The swivelling axis 7 of the support arm connects the cover 19 of the protective housing 10 and therefore also the support arm 6 to the machine body, the cover 19 being screwed to the protective housing 10. As FIG. 3 shows, the swivelling axis 7 is situated in the top part of the cover 19 above the axis of the driving motor 9, in which a row of pressure cylinders 13 is arranged underneath it. The piston rods 15 of the clyinders are received in a cavity 21 of the cover 19 and are fixed therein so as to be swivellable about an axis 22. The pressure cylinders 13 themselves are supported with their rearward ends in a front-ended cavity 23 formed in the machine body, so as to be swivellable about an axis 24.

Although the invention has been shown in connection with a certain specific embodiment, it will be readily apparent to those skilled in the art that various changes in form and arrangement of parts may be made to suit requirements without departing from the spirit and scope of the invention.

I claim as my invention.

1. In a drum cutter-loader machine for an underground long wall mining operation having a machine body and a cutting drum traversable longitudinally along said wall, said body having a limiting height characteristic extending in a direction parallel to said wall such as to assure passage of said body in a minimum height long wall mining condition, a support arm for the drum mounted on one end of said body, such that the inner end of said arm is connected to said body and its outer end is connected to the drum, said arm being pivotally carried by said body about an axis generally parallel to the mine floor, driving motor means for driving the drum, a protective housing for said motor means, means for mounting said housing at said inner end of said arm on the side thereof opposite the side to which the drum is connected and in a manner that the motor means and housing extends away from said arm so that the axis of the housing is arranged parallel to the axis of the drum, said motor means and housing being arranged to extend in line with and in front of said body and characterized so as not to exceed said height of said body, said housing and body having first means for pivotally connecting said housing to said body, pressure cylinders arranged transversely of said body and between said arm and said body for rotating said arm, said housing having second means on one side of said first pivotal connection for pivotally connecting one end of said cylinders to said housing, third pivotal means for pivotally connecting a second end of said cylinders to said body, and said first, second and third means having their axes generally parallelly arranged and being located within said height of said body, in a manner that said cylinders are maintained at all times during their operations within said height of said body.

2. The improvement according to claim 1, wherein said pressure cylinders are arranged in two rows, one row directly above the other, and wherein said rows are arranged on either side of said first pivotal connection.

3. The improvement according to claim 1, wherein said pressure cylinders are arranged in two rows and adapted to be actuated in the same direction by rows in such a way that both rows of cylinders act on said support arm simultaneously in the same rotational direction.

4. The improvement according to claim 2, wherein said housing includes a pressure cylinder connecting portion which extends into the area of said first pivotal connection, said portion extending laterally of said body for receiving said rows of pressure cylinders.

5. The improvement according to claim 1, wherein said machine body includes a shoulder means arranged adjacent said inner end of said support arm, said housing includes extending walls arranged on the side of said motor opposite said mine floor, and means for connecting said walls to said first pivotal connection on the side of said machine body adjacent said floor, in which said machine body and said housing on said side adjacent said floor are formed with cavities for receiving said pressure cylinders.

6. The improvement according to claim 1, wherein said cylinders including piston rods connected to said second means and said cylinders are connected to said third means.

7. The improvement according to claim 1, wherein said first and second means are arranged in substantially the same plane.

8. In a drum cutter-loader machine for an underground mining operation having a machine body and cutting drums arranged on opposite ends of said machine body, each drum being mounted on one side of an associated support arm, each said arm being pivotally carried by said machine body about an axis parallel to the mine floor, driving motor means connected to the opposite side of each said support arm for driving its associated drum, each said motor means being arranged in a protective housing which is fastened to its associated support arm, pressure cylinders connected to each said housing for adjusting its arm, the combination therewith of the improvement, wherein said pressure cylinders for each arm have their piston rods located on a first common axis, and arranged between said machine body and said housing so as to exert a rotating force on an associated said housing, said first axis arranged parallel to the pivot axis of an associated said support arm, means for mounting the cylinder ends of said pressure cylinders on the machine body so as to be pivoted about a second common axis which is parallel to said first common axis, wherein said machine body for each said arm includes a series of spaced shoulder means, each said housing having a series of spaced ribs means cooperatively arranged with said shoulder means, said shoulder means and said rib means arranged so that each said pressure cylinder is located between two said shoulder means and two said rib means, said mounting means including trunion means connecting said pressure cylinders to said shoulder means in a diametrical opposite relationship with respect to said pivot axis of an associated said support arm, said pivot axis of each said support arm being formed by other trunion means carried by said shoulder means and said rib means.

* * * * *